United States Patent [19]

Ryder

[11] Patent Number: 5,072,634

[45] Date of Patent: Dec. 17, 1991

[54] DEVICE FOR REMOVING SPIKES FROM SHOES

[76] Inventor: Fred Ryder, 1992 Cambridge Dr., Crofton, Md. 21114

[21] Appl. No.: 597,348

[22] Filed: Oct. 10, 1990

[51] Int. Cl.[5] ..... B25B 13/48

[52] U.S. Cl. ..... 81/176.15; 81/461; 81/177.1; 81/489

[58] Field of Search ..... 81/35, 124.5, 177.1, 81/177.5, 176.15, 461, 489

[56] References Cited

U.S. PATENT DOCUMENTS

| | | | |
|---|---|---|---|
| 1,537,657 | 5/1925 | Burch | 81/35 X |
| 1,714,361 | 5/1929 | Gougler | 81/35 |
| 2,539,532 | 1/1951 | Daniels | 81/176.15 X |
| 2,770,991 | 11/1956 | Myers | 81/176.15 |
| 2,881,648 | 4/1959 | Hottle | 81/176.15 |
| 3,649,976 | 3/1972 | Isom | 81/176.15 X |
| 4,092,882 | 6/1978 | Whitmore | 81/461 X |
| 4,825,733 | 5/1989 | Chinchar | 81/177.5 X |

*Primary Examiner*—James G. Smith

*Attorney, Agent, or Firm*—Rogers & Killeen

[57] ABSTRACT

Golf spikes may be removed from golf shoes with a device operable with two hands by the application of a rotational force substantially about the axis of the spike. The device may include a body with two male members adapted to engage the female receptacles in a golf spike and two rigidly spaced-apart handles, each adapted to be gripped by one hand and each having a portion directed opposite the male members. When the two handles are each gripped by one hand a rotational force may be applied to the golf spike without application of a lateral force.

9 Claims, 1 Drawing Sheet

DEVICE FOR REMOVING SPIKES FROM SHOES

BACKGROUND OF THE INVENTION

The present invention relates to devices for removing spikes from footwear. More particularly, it relates to a device operable with two hands for enabling the application of a rotational force to a golf spike to facilitate the spike's removal from a golf shoe.

A golf spike is normally attached to the sole of a golf shoe with a threaded male-female connection. Typically, threaded sockets are built into the bottom of the heel and sole of a shoe. Each of the sockets mates with the threads of a post on the bottom of a spike for rotation of the spike on the bottom of the shoe. The spike is attached to the shoe by threading the post of the spike into one of the sockets of the shoe and detached by reversing the threading motion. Thus, a torque must be applied to the golf spike to remove it from the golf shoe. During normal use, the golf spike may become corroded and difficult to remove. It is not uncommon to require the use of extreme force or even power tools to remove the spike. Typically, female receptacles are provided on either side of the spiked portion of the golf spike to enable the application of the torque to the spike. Hand tools of various sorts have been used to engage the female receptacles for the transfer of the torque from the hand to the spike.

Even with the use of hand tools, however, the removal of spikes has heretofore often been quite difficult. Because of the spike's placement at the bottom of the shoe, water, dirt, chemicals and other foreign substances foul the area of engagement between the spike and its socket, making removal difficult. Further, the spikes, which may be made of metal or plastic, are frequently bent and chipped during normal use which may result in undesired engagement between the base of the spike and the shoe, in wearing or partial destruction of the female receptacles, and/or in changes to the portion of the spike with which the hand tools are designed to engage, all of which make unthreading more difficult.

Golf spike wrenches adapted to engage the female receptacles and to apply torque to remove the spike are known. Typically such golf spike wrenches are designed to be operated with one hand. The wrench is gripped in the palm of a hand and twisted with a motion that includes bending the wrist of the user. That is, the arm of the user is flexed at the wrist. By so doing, however, the normal user applies torque (a rotational force) and pushes the wrench (applies a lateral force). Generally, the user is unable to apply a pure rotational force to the wrench, and ultimately to the golf spike, because of the inherent structure of the wrist which also moves laterally during application of a twisting motion. Because golf spike wrenches are typically operated with one hand and because energy is wasted by the application of the lateral force, the extreme force needed to remove a corroded or fouled golf spike may not be available to a normal user. Further, the application of an extreme force in combination with the lateral force may cause the female receptacles of the golf spike to become worn and of little or no further use. The one-handed golf spike wrench may also be unsafe to use because the user risks scraping his hand (e.g., the knuckles) on the other golf spikes in the sole of the shoe should the wrench slip from the spike. See, for example, U.S. Pat. No. 2,222,145 to James, U.S. Pat. No. 2,881,648 to Hottle and U.S. Pat. No. 3,447,171 to Eyer.

While various attempts have been made to apply a rotational force to the golf spike to facilitate its removal, the various solutions are generally directed to removing the spike with a single hand and may be complicated and expensive to manufacture. See for example, U.S. Pat. No. 3,140,625 to Pannozzo and U.S. Pat. No. 4,262,562 to MacNeill.

While traditional hand tools such as needle nose pliers may also be used to remove a golf spike, the handles of such devices are not fixed in relation to one another and must be gripped tightly to remove the spike. The gripping action detracts from the application of a pure rotational force and may further damage the golf spike. See, for example, U.S. Pat. No. 2,408,737 to Cormier.

It has also been observed that many golf shoes have soft soles which resiliently deform when subjected to downward pressure. In such shoes the removal of golf spikes may be especially difficult with the traditional golf spike wrench which normally requires the application of a downward force toward the sole of the shoe to prevent disengagement of the female receptacles from the male members of the golf spike wrench. It has been found that soft soled golf shoes do not allow the application of sufficient downward force to avert damage to the female receptacles.

Accordingly, it is an object of the present invention to provide a novel device for removing a golf spike from a golf shoe that is easy to manufacture and use and that enables application of a pure rotational force to the golf spike.

It is a further object of the present invention to provide a novel device for removing a golf spike from a golf shoe that may be operated with two hands without flexing the wrists of the user.

It is yet a further object of the present invention to provide a novel device for removing a golf spike from a golf shoe that may be operated with two hands with the palms of the hands facing each other.

It is still a further object of the present invention to provide a novel device for removing a golf spike from a golf shoe that reduces the rotational friction between the hand of the user and the device.

It is another object of the present invention to provide a novel device for removing a golf spike from a golf shoe that may be safely operated with either one or two hands.

These and many other objects and advantages will be readily apparent to one skilled in the art to which the invention pertains from a perusal of the claims, the appended drawings and the following detailed description of preferred embodiments.

DETAILED DESCRIPTION OF PREFERRED EMBODIMENTS

Figure 1:
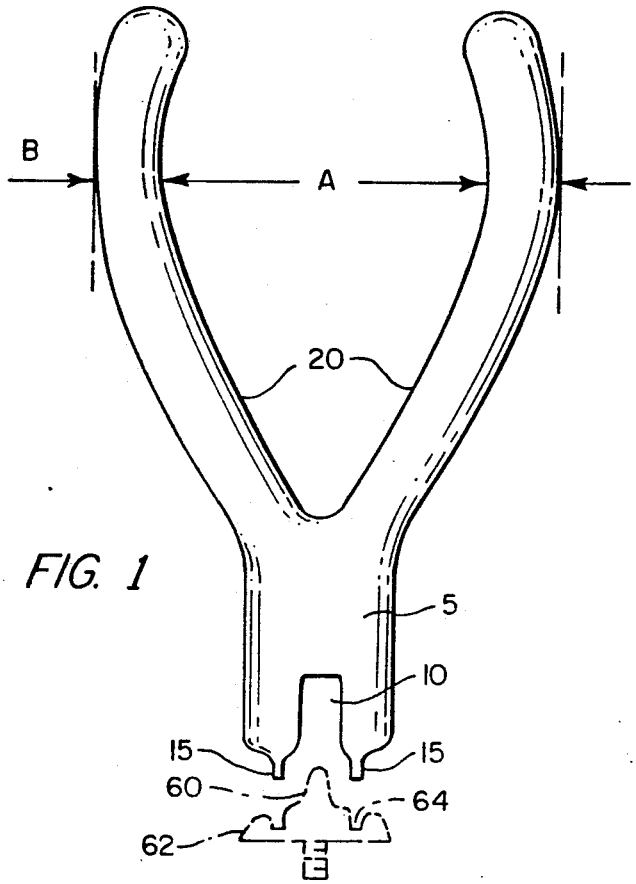
FIG. 1 is a pictorial depiction of a plan view of an embodiment of the present invention.

With reference now to the figures, where like elements have been given like numerical designations to facilitate an understanding of the present invention, and with particular reference to FIG. 1, the present invention may include a body 5 having a recess 10 therein adapted to receive the spiked portion 60 of a golf spike 62 when the body 5 is positioned on the golf spike, two male members 15 adapted to engage female receptacles 64 in the golf spike 62, the male members extending from the body on either side of the recess 10, and two handles 20 rigidly spaced apart and extending from the body in a direction generally opposite the male members, each handle being adapted to be held by a single hand.

The two handles 20 may have portions sufficiently spaced apart a distance A so that when each handle is being held, the hand holding one handle does not interfere with the hand holding the other handle. The handles may be arranged so that when they are being held the palms of the two hands holding the handles are facing each other. That is, the handles may be gripped by hands that appear to be giving two "thumbs up" signs. The distance A is preferably about two inches or more.

In operation, the device of the present invention enables the application of a rotational force to the golf spike without application of a substantial lateral force. When two hands are gripping the two handles, a rotational force may be applied by moving one of the two hands closer to the user and the other away from the user. The motion is accomplished with the shoulders and/or elbows. Wrist action is not necessary and, thus, a lateral force is not applied. The shoe bearing the spike being removed may be held between the thighs of the user.

Because the application of a lateral force may be avoided with the present invention, the downward force tending to keep the male member and female receptacles engaged may be reduced. The reduction of the downward force reduces the tendency of the female receptacles to become worn and allows use of the device with soft soled golf shoes. Because the user is not required to push down hard to engage the female receptacles, the likelihood that the hand of the user will inadvertently scrape the other golf spikes in the sole of the golf shoe is reduced.

The handles 20 may also be arranged so that the device may be optionally used with one hand. One-handed use may be appropriate after the spike has been loosened sufficiently by two-handed application of a rotational force. The handles 20 may be sufficiently spaced apart to allow two-handed operation, while the maximum distance between the outermost edges of the handles (distance B in FIG. 1) may be sufficiently close to allow a user to grip the device with one hand. For example, the distance B may be between about two and one half and three and one half inches.

In the embodiment of FIG. 1, there is no substantial contact between the wrench and the spike 62 except at the male members 15. Accordingly, the operation of the wrench does not depend upon the smoothness or regularity of the top of the spike 62 and the operation of the wrench is not inhibited or interfered with by damage to or organic growth on the body of the spike 62.

The embodiment of FIG. 1 may be manufactured from one or more pieces of cast metal or other materials having sufficient structural strength.

Figure 2:
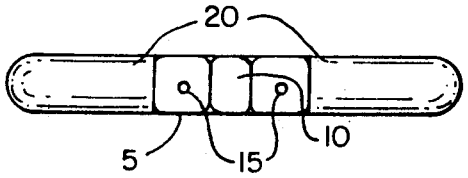
FIG. 2 is a pictorial depiction of an end view of the embodiment of FIG. 1.

With reference now to FIG. 2, an end view of the embodiment of FIG. 1, the present invention may be flat for convenient storage and have sufficient thickness to provide the requisite strength for the material of manufacture.

Figure 3:
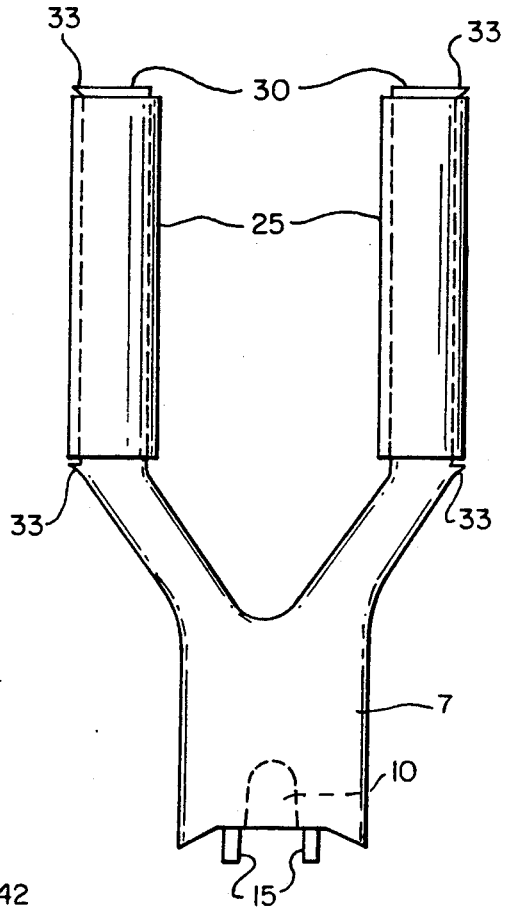
FIG. 3 is a pictorial depiction of a further embodiment of the present invention illustrating a tubular means for reducing friction.

With reference now to FIG. 3 a further embodiment of the present invention may include two tubular members 25 positioned over appropriately shaped handles 30 for facilitating the application of the rotational force. The tubular members 25 may rotate so that when the device of this embodiment is gripped with two hands and the rotational force is applied, there is little or no rotational friction between the hands holding the device and the handles 30. The rotating tubular members 25 may be attached to the handles 30 with any suitable means, including fillets 33.

With further reference to FIG. 3, the body 7 may be shaped as required to provide structural strength (e.g., cylindrical). The portion of the body 7 having the recess 10 may be shaped to conform to the golf spike for better male-female engagement.

Figure 4:
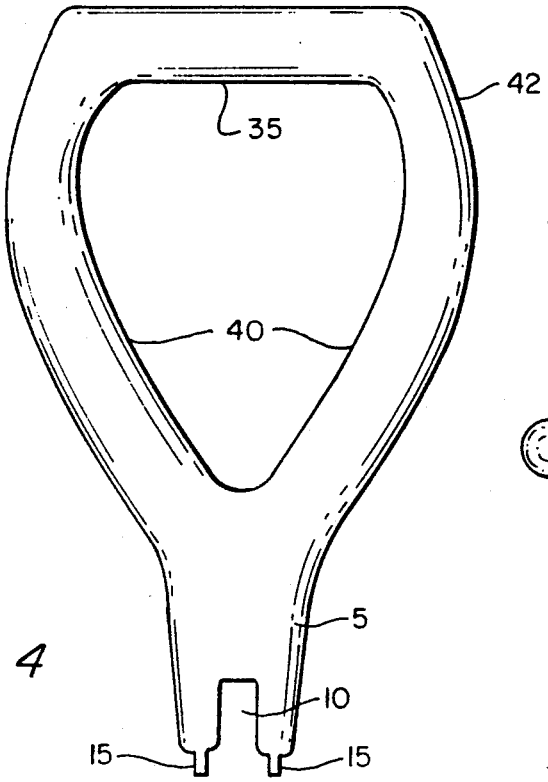
FIG. 4 is a pictorial depiction of a further embodiment of the present invention illustrating means by which the device may be operated by one or two hands.

With reference now to FIG. 4, a further embodiment of the present invention may include a transverse member 35 affixed to the handles 40 adjacent the ends 42 most remote from the body 5. As with the embodiment of FIG. 1, the handles 40 may be adapted to be gripped by two hands. The transverse member 35 may be adapted to be gripped by a single hand to enable safe, one-handed operation and to facilitate storage of the device. When the transverse member 35 is gripped with one hand, the hand is far enough from the other golf spikes to avoid contact.

While preferred embodiments of the present invention have been described, it is to be understood that the embodiments described are illustrative only and that the scope of the invention is to be defined solely by the appended claims when accorded a full range of equivalents, many variations and modifications naturally occurring to those skilled in the art from a perusal thereof.

I claim:

1. A device for removing a golf spike from a golf shoe, the device enabling the application of a rotational force to the golf spike to facilitate the spike's removal, the device comprising:

(a) a body having a recess adapted to receive a spike portion of a golf spike when the body is positioned on the golf spike;

(b) two rigidly spaced-apart male members adapted to engage female receptacles in a golf spike, the male members having generally parallel longitudinal axes extending a first direction from the body with the recess therebetween; and (c) two rigidly spaced-apart handles extending from the body for enabling application of a rotational force to the body, each of the handles extending from the body in a direction generally opposite the first direction, said handles being spaced apart so that said handles can be held simultaneously by one hand or can be held individually by two hands.

2. The device as defined in claim 1 further comprising two generally tubular hand-held members, each rotatably overlying one of the two handles, for reducing friction between the handles and hands holding the device.

3. The device as defined in claim 1 wherein the portions of the handles adapted to be held by one hand are at least about two inches apart.

4. The device as defined in claim 3 wherein the portions of the handles adapted to be held by one hand have outermost edges between about two and one half and three and one half inches apart.

5. The device as defined in claim 1 further comprising a transverse member adapted to be held by one hand and affixed to the two handles adjacent ends remote from the body so that torque may be applied to the body by application of a twisting motion to the transverse member.

6. A golf spike removal tool, comprising:

two parallel male members extending in a first direction and spaced apart from each other by the horizontal distance between a pair of female receptacles in a golf spike, the male members each being adapted at a first end to be received within the female receptacles; and two spaced-apart handles, each connected to one of the male members at a second end and extending from the male members in a direction generally opposite the first direction, the handles being adapted to transfer rotational motion about the handles into rotational motion about the male members when rotational motion is imparted by a single hand gripping both said handles or when rotational motion is imparted by two hands, one gripping each of said handles, the distance between said handles being fixed prior to the use of the tool.

7. The tool of claim 6 wherein the rotation about the handles is supplied by inwardly facing hands.

8. The tool of claim 6 wherein the handles may be rotated by a human hand about their central axis without a substantial lateral force.

9. The tool of claim 6 wherein the golf spike is contacted by the tool only at the female receptacles.

* * * * *